US010941976B2

(12) United States Patent
Kim et al.

(10) Patent No.: US 10,941,976 B2
(45) Date of Patent: Mar. 9, 2021

(54) REFRIGERATOR

(71) Applicant: Samsung Electronics Co., Ltd., Suwon-si (KR)

(72) Inventors: Byoung Mok Kim, Hwaseong-si (KR); Seok-Jun Son, Hwaseong-si (KR); Jung-Geun Lee, Hwaseong-si (KR); Sang Gyu Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/863,246

(22) Filed: Apr. 30, 2020

(65) Prior Publication Data

US 2020/0256613 A1 Aug. 13, 2020

Related U.S. Application Data

(63) Continuation of application No. 16/018,727, filed on Jun. 26, 2018, now Pat. No. 10,684,065.
(Continued)

(30) Foreign Application Priority Data

Aug. 30, 2017 (KR) ..... 10-2017-0110436

(51) Int. Cl.
*F25D 23/02* (2006.01)
*F25D 11/00* (2006.01)
(Continued)

(52) U.S. Cl.
CPC ..... *F25D 23/028* (2013.01); *F25D 11/00* (2013.01); *F25D 23/025* (2013.01);
(Continued)

(58) Field of Classification Search
CPC ..... F25D 11/00; F25D 23/00; F25D 23/25; F25D 23/28; F25D 25/005; F25D 29/005
(Continued)

(56) References Cited

U.S. PATENT DOCUMENTS 8,123,314 B2 2/2012 Becke
8,439,462 B2 5/2013 Seo
(Continued)

FOREIGN PATENT DOCUMENTS

JP 2015-45447 3/2015
KR 10-2002-0056773 7/2002
(Continued)

OTHER PUBLICATIONS

U.S. Office Action dated Aug. 16, 2019 in U.S. Appl. No. 16/018,727.
(Continued)

*Primary Examiner* — James O Hansen
(74) *Attorney, Agent, or Firm* — Staas & Halsey LLP

(57) ABSTRACT

Disclosed herein is a refrigerator which allows a user to check the status of a storage chamber with a camera without opening a door. The refrigerator includes a body having a storage chamber, a door rotatably coupled to the body to open or close the storage chamber, a frame coupled to the door and including a housing in which a camera configured to photograph the inside of the storage chamber is installed, and a first door bin configured to receive an object to be cooled, detachably coupled to the frame, and located on an upper portion of the housing to be supported by the housing.

10 Claims, 11 Drawing Sheets

Related U.S. Application Data

(60) Provisional application No. 62/524,882, filed on Jun. 26, 2017.

(51) Int. Cl.
*F25D 25/00* (2006.01)
*F25D 29/00* (2006.01)

(52) U.S. Cl.
CPC ..... *F25D 25/005* (2013.01); *F25D 29/005* (2013.01); *F25D 2323/023* (2013.01); *F25D 2700/06* (2013.01)

(58) Field of Classification Search
USPC ..... 312/401, 404, 405, 405.1, 408, 223.6
See application file for complete search history.

(56) References Cited

U.S. PATENT DOCUMENTS

| | | | | |
|---|---|---|---|---|
| 2010/0270902 | A1 | 10/2010 | Ki M | |
| 2011/0181163 | A1 | 7/2011 | Han | |
| 2012/0286638 | A1 | 11/2012 | Lee | |
| 2013/0015753 | A1* | 1/2013 | Son | B01D 46/00 312/405 |
| 2013/0320828 | A1* | 12/2013 | Nitzsche | F24C 15/024 312/237 |
| 2014/0239790 | A1 | 8/2014 | Yoo | |
| 2014/0293060 | A1 | 10/2014 | Ryu | |
| 2016/0033194 | A1 | 2/2016 | Sumihiro | |
| 2016/0057394 | A1 | 2/2016 | Marutani | |
| 2016/0116207 | A1* | 4/2016 | Yamato | A47B 81/06 312/7.1 |
| 2016/0138860 | A1 | 5/2016 | Kang | |
| 2016/0146527 | A1 | 5/2016 | Kim | |
| 2016/0165131 | A1 | 6/2016 | Ryu | |
| 2016/0182868 | A1 | 6/2016 | Izawa | |

FOREIGN PATENT DOCUMENTS

| | | |
|---|---|---|
| KR | 10-2006-0099985 | 9/2006 |
| KR | 10-2016-0140079 | 12/2016 |

OTHER PUBLICATIONS

U.S. Notice of Allowance dated Feb. 10, 2020 in U.S. Appl. No. 16/018,727.
U.S. Appl. No. 16/018,727, filed Jun. 26, 2018, Byoung Mok Kim et al., Samsung Electronics Co., Ltd.

* cited by examiner

REFRIGERATOR

CROSS-REFERENCE TO RELATED APPLICATIONS

This application is a continuation application of U.S. patent application Ser. No. 16/018,727, filed on Jun. 26, 2018, which claims priority under 35 U.S.C. § 119 to U.S. Provisional Patent Application No. 62/524,882, filed on Jun. 26, 2017 and Korean Patent Application No. 10-2017-0110436, filed on Aug. 30, 2017 in the Korean Intellectual Property Office, the disclosures of which are incorporated by reference herein in their entirety.

BACKGROUND

1. Field

Embodiments of the present disclosure relate to a refrigerator, and more particularly, to a refrigerator including a camera unit.

2. Description of Related Art

In general, a refrigerator is a home appliance including a storage chamber for storing food, and a cool-air supply apparatus for supplying cool air to the storage chamber, to keep the food fresh.

The conventional refrigerator only has a function of storing food in a low temperature. However, recently, a need for additional functions, in addition to the food storage function, is increasing.

In order for the user to check the inside of the refrigerator having items stored therein, the user has to open the door of the refrigerator. Also, if the user buys groceries in the market or mall without knowing the amounts and kinds of what are stored in the refrigerator, he/she may buy the same kinds of food as those stored in the refrigerator, or may not buy necessary food.

SUMMARY

It is an aspect of the present disclosure to provide a refrigerator capable of photographing a storage chamber.

It is another aspect of the present disclosure to provide a refrigerator allowing the user to see the inside of a storage chamber from the outside.

It is another aspect of the present disclosure to provide a refrigerator having a camera installed therein at the center of the door in the width direction so that the camera may take a distortionless image of the inside of the storage chamber.

It is another aspect of the present disclosure to provide a refrigerator that facilitates coupling of a frame having a camera mounted thereon to the rear of a door without a separate fastening member.

Additional aspects of the present disclosure will be set forth in part in the description which follows and, in part, will be obvious from the description, or may be learned by practice of the present disclosure.

In accordance with an aspect of the present disclosure, a refrigerator includes a body having a storage chamber, a door rotatably coupled to the body to open or close the storage chamber, a frame coupled to the door and including a housing in which a camera configured to photograph the inside of the storage chamber is installed, and a first door bin configured to receive an object to be cooled, detachably coupled to the frame, and located on an upper portion of the housing to be supported by the housing.

The frame may further include a coupling bar extending vertically from both ends of the housing and coupled to the door.

The door may include an inner door including an opening corresponding to the storage chamber and rotatably coupled to the body, and an outer door rotatably coupled to the inner door to open or close the opening.

The inner door may include a coupling protrusion provided on inner edges of the inner door, and the coupling bar may include a protrusion coupling portion provided on one surface of the coupling bar to be coupled with the coupling protrusion.

The coupling bar may further include a bin coupling portion provided on the other surface of the coupling bar, and the first door bin may include a coupling groove formed by recessing at least one surface of the first door bin, and the bin coupling portion may be configured to be inserted into the coupling groove.

The protrusion coupling portion and the bin coupling portion may be provided at positions corresponding to each other.

An upper surface of the housing may contact a lower surface of the first door bin to support the first door bin.

An upper surface of the housing and a lower surface of the first door bin may be provided in sizes and shapes corresponding to each other.

The refrigerator may further include a second door bin bigger than the first door bin and detachably coupled to the door.

The refrigerator may further include a wire configured to connect the camera and the inside of the body, and the frame may accommodate the wire.

The housing may further include a wire hole linking the housing and the coupling bar, and the wire may be drawn out of the housing through the wire hole.

The frame may further include a connector module arranged between the coupling bar and the door, and the wire and the body wire drawn from the inside of the body may be connected to the connector module.

The wire may include a connector provided at one end of the wire and detachably coupled to the connector module.

In accordance with an aspect of the present disclosure, a refrigerator includes a body having a first storage chamber and a second storage chamber arranged laterally, an inner door rotatably coupled to the body and including an opening corresponding to the first storage chamber or the second storage chamber, an outer door rotatably coupled to the inner door to open or close the opening, a frame including a camera configured to photograph the inside of the storage chamber corresponding to the opening, and coupled to a rear surface of the inner door, and a first door bin configured to receive an object to be cooled and detachably coupled to the frame.

The refrigerator may further include a second door bin provided to be bigger than the first door bin and detachably coupled to the inner door.

The frame may include a housing in which the camera is installed, and a coupling bar extending vertically from both ends of the housing and coupled to the inner door.

The inner door may include a coupling protrusion provided on inner edges of the inner door, and the coupling bar may include a protrusion coupling portion provided on one surface of the coupling bar to be coupled with the coupling protrusion.

The coupling bar may further include a bin coupling portion provided on the other surface of the coupling bar.

The first door bin may include a coupling groove formed by recessing at least one surface of the first door bin, and the bin coupling portion may be configured to be inserted into the coupling groove An upper surface of the housing may contact a lower surface of the first door bin to support the first door bin.

In accordance with an aspect of the present disclosure, a refrigerator includes a body having a storage chamber, an inner door rotatably coupled to the body and including a first opening and a second opening arranged vertically, a first outer door rotatably coupled to the inner door to open or close the first opening, a second outer door rotatably coupled to the inner door independently of the first outer door to open or close the second opening, and a frame including a camera configured to photograph the inside of the storage chamber, the frame coupled to a rear surface of the inner door and supporting a door bin configured to receive an object to be cooled.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
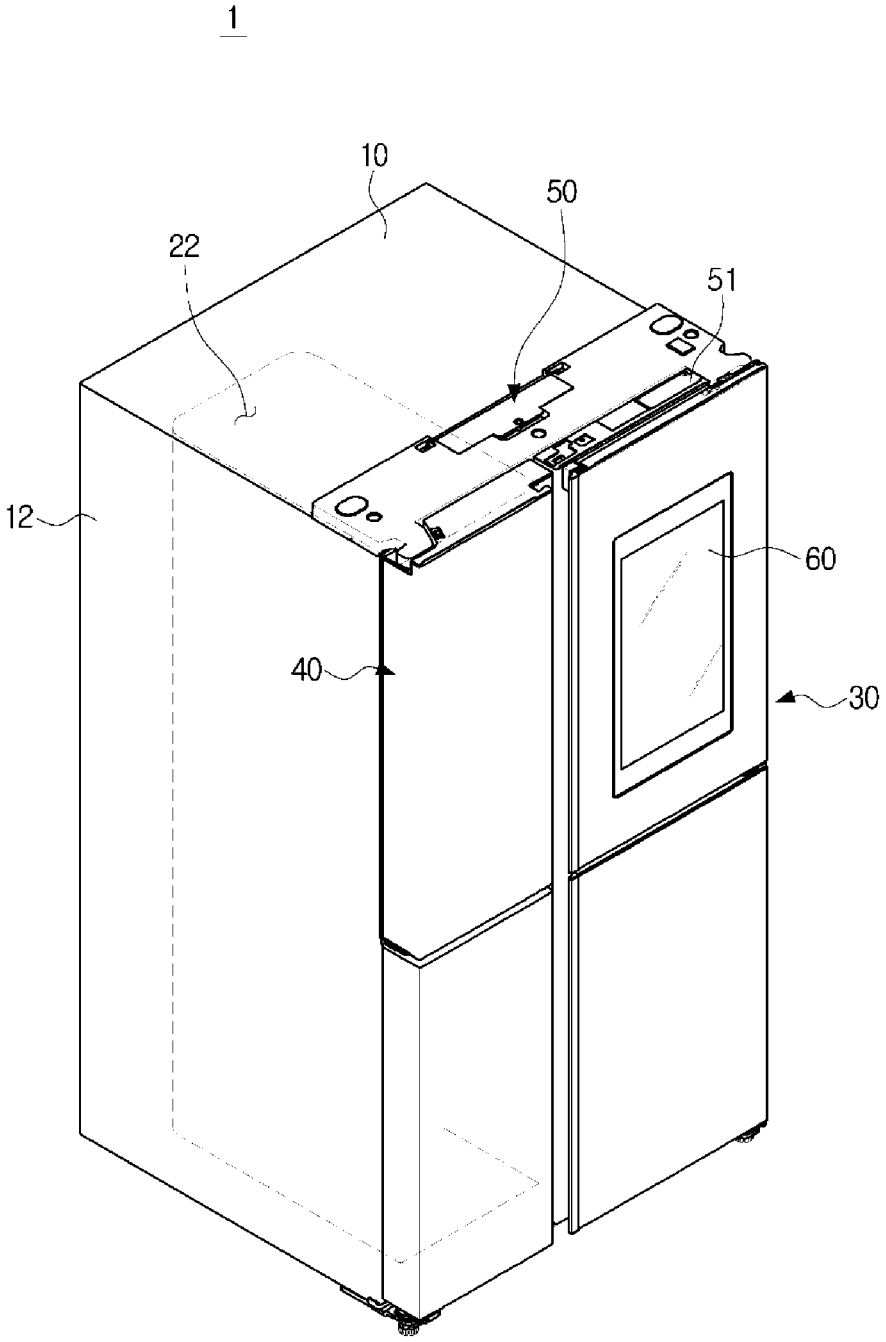
FIG. 1 is an exterior view of a refrigerator with a door closed, according to an embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

Hereinafter, embodiments according to the present disclosure will be described in detail with reference to the accompanying drawings.

In general, a refrigerator is a home appliance including a storage chamber for storing food, and a cool air supply apparatus for supplying cool air to the storage chamber, to keep the food fresh. The refrigerator may be classified by location of storage chambers and doors.

There are a Top Mounted Freezer (TMF) type refrigerator in which a storage chamber is partitioned into an upper freezing chamber and a lower refrigerating chamber by a horizontal partition wall, and a Bottom Mounted Freezer (BMF) type refrigerator having a refrigerating chamber in the upper portion and a freezing chamber in the lower portion.

Also, there are a Side By Side (SBS) type refrigerator in which a storage chamber is partitioned by a vertical partition wall into left and right sections: a freezing chamber and a refrigerating chamber, and a French Door Refrigerator (FDR) type refrigerator in which a storage chamber is partitioned by a horizontal partition wall into an upper refrigerating chamber and a lower freezing chamber, wherein the upper refrigerating chamber is opened or closed by a pair of doors.

Meanwhile, each door of the refrigerator may include a gasket to seal the gap between the door and the main body when the door is closed.

A refrigerator according to an embodiment of the present disclosure is, for convenience of description, assumed to be a SBS type refrigerator, without being limited thereto.

Figure 2:
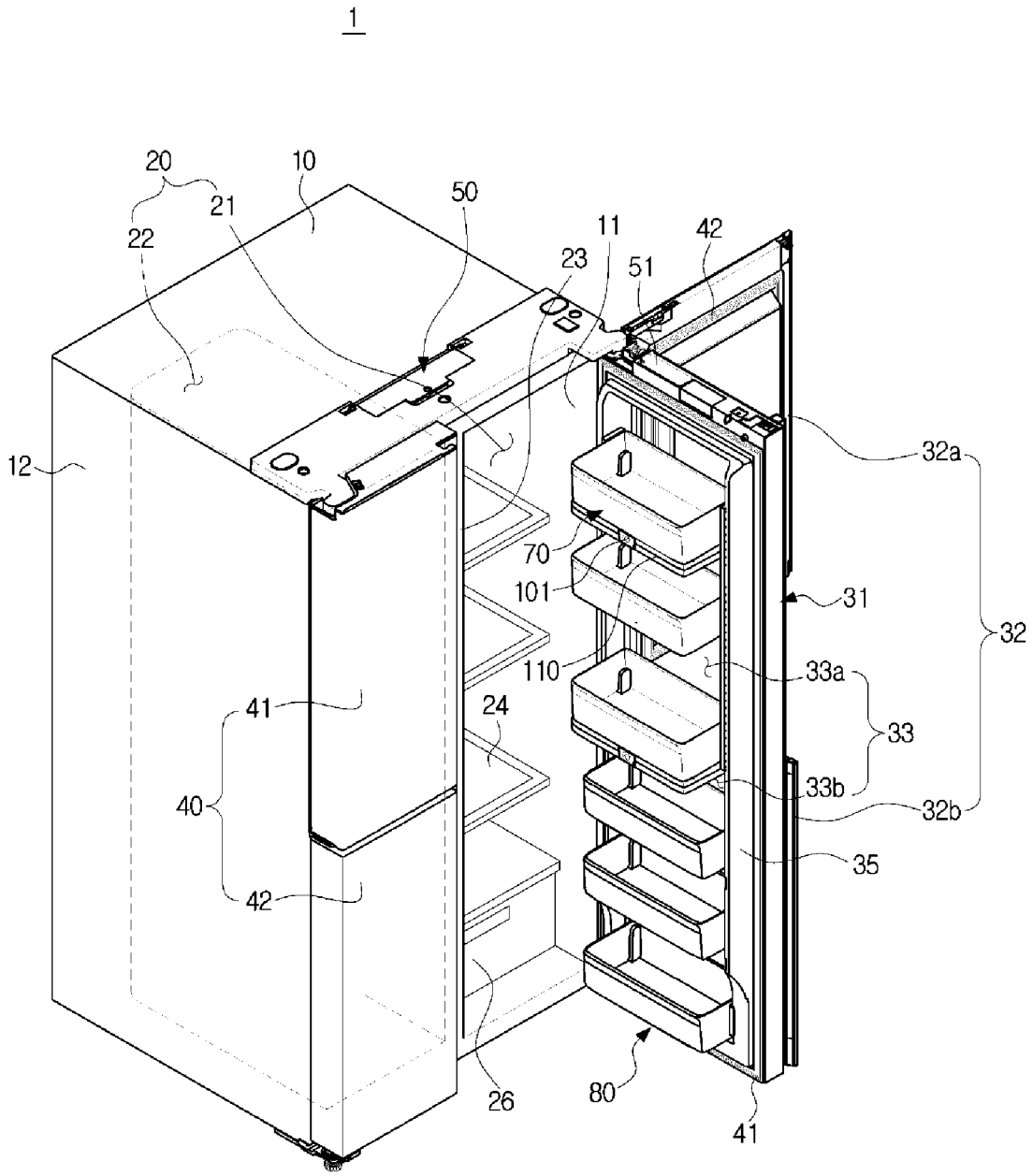
FIGS. 2 and 3 are exterior views of a refrigerator with a door partially opened, according to an embodiment of the present disclosure.
Figure 3:
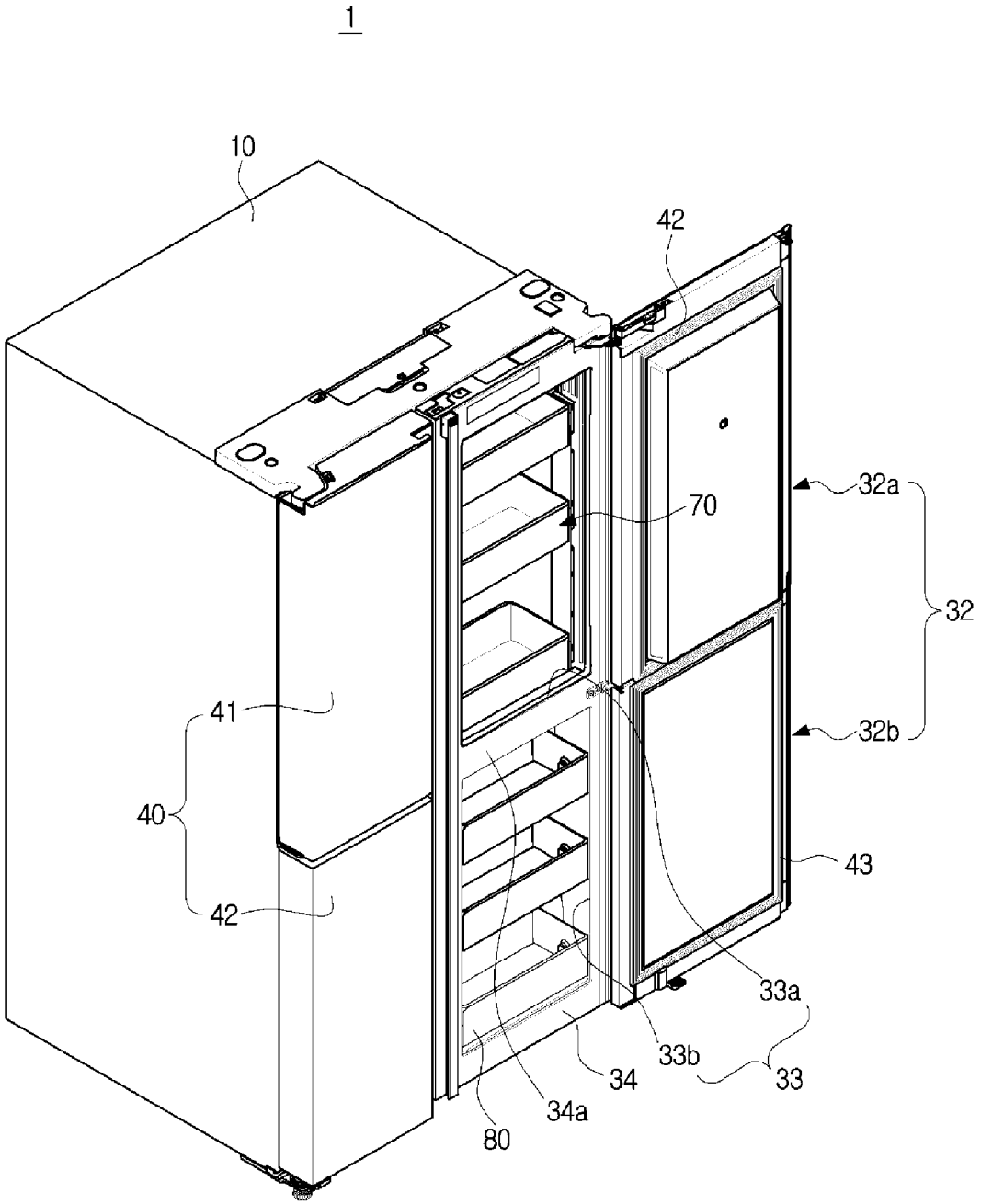

FIG. 1 is an exterior view of a refrigerator with a door closed, according to an embodiment of the present disclosure. FIGS. 2 and 3 are exterior views of a refrigerator with a door partially opened, according to an embodiment of the present disclosure.

A refrigerator 1 includes a body 10 forming an outer appearance, a storage chamber 20 formed by dividing the body 10 into left and right sections, a door 30 configured to open or close the storage chamber 20, and a cool air supply apparatus (not shown) for supplying cool air into the storage chamber 20.

The cool air supply apparatus may include a compressor, a condenser, an expansion valve, an evaporator, a blower fan, a cool air duct, and the like.

A machine room (not shown) in which the compressor for compressing a refrigerant and the condenser for condensing the compressed refrigerant are installed may be provided in the lower rear side of the body 10.

The body 10 may include an inner cabinet 11 forming the storage chamber 20, an outer cabinet 12 coupled to the outer side of the inner cabinet 11 and forming the outer appearance of the refrigerator 1, and an insulator (not shown) foamed between the inner cabinet 11 and the outer cabinet 12 to insulate the storage chamber 20.

The cool air supply apparatus may generate cool air through a cooling circulation cycle of compressing, condensing, expanding, and evaporating refrigerants.

The storage chamber 20 may be partitioned into a first storage chamber 21 and a second storage chamber 22 by a vertical partition 23. The refrigerator 1 according to an embodiment of the present disclosure may be an SBS type refrigerator in which the first storage chamber 21 and the second storage chamber 22 are located on the right and left sides.

The first storage chamber 21 may be located on the right side and the second storage chamber 22 may be located on the left side. The first storage chamber 21 may be a refrigerating chamber and the second storage chamber 22 may be a freezing chamber. However, the positions of the refrigerating chamber and the freezing chamber may be changed.

The first storage chamber 21 may be provided with a shelf 24 on which food may be placed and a drawer 26 slidingly drawn out from the first storage chamber 21 or slidingly put into the first storage chamber 21.

The storage chamber 20 has the open front to put in/out food, and the open front may be opened or closed by the doors 30 and 40.

The doors 30 and 40 may include a first door 30 for opening or closing the first storage chamber 21 and a second door 40 for opening or closing the second storage chamber 22.

The first storage chamber 21 may be opened or closed by the first door 30 rotatably coupled to the body 10. The second storage chamber 22 may be opened or closed by the second door 40 rotatably coupled to the body 10.

In the refrigerator 1 according to an embodiment of the present disclosure, the first door 30 for opening or closing the first storage chamber 21 may be provided as a double door. Accordingly, the first door 30 may include an inner door 31 and an outer door 32.

In the refrigerator 1 according to an embodiment of the present disclosure, each of the outer door 32 and the second door 40 may include an upper door and a lower door arranged vertically. However, the present disclosure is not limited thereto. The outer door and the second door may not be vertically separated, and the first door may be an ordinary door rather than the double door.

Hereinafter, it is assumed that the first door 30, which opens or closes the first storage chamber 21, is provided as a double door, and the outer door 32 is vertically separated.

The first door 30 may be provided as a double door. The first door 30 may include an inner door 31 and an outer door 32.

The outer door 32 may include a first outer door 32*a* and a second outer door 32*b*, which are vertically arranged. The first outer door 32*a* and the second outer door 32*b* may be opened or closed separately, and may be opened or closed together with the inner door 31.

The inner door 31 may include an opening 33 corresponding to the first storage chamber 21. The opening 33 may include a first opening 33*a* and a second opening 33*b* which are arranged in a vertical direction. The first opening 33*a* and the second opening 33*b* may be separated by a horizontal partition wall 34*a* provided in the inner door 31.

The first opening 33*a* may be opened or closed by the first outer door 32*a* and the second opening 33*b* may be opened or closed by the second outer door 32*b*. For this, the outer door 32 may be rotatably coupled to the inner door 31.

Hereinafter, one surface of the inner door 31 facing the first storage chamber 21 is referred to as a rear surface of the inner door 31. A first door bin 70 and a second door bin 80, which may store food, may be provided on the rear surface of the inner door 31. Each of the first door bin 70 and the second door bin 80 may be detachably coupled to the rear surface of the inner door 31. Details will be described later.

A gasket 41 may be provided on the rear edges of the inner door 31 to seal a gap with the body 10 while the inner door 31 is closed. The gasket 41 may be installed in the shape of a loop along the edges of the rear surface of the inner door 31, and a magnet (not shown) may be incorporated therein.

Similar to the inner door 31, a gasket 42, 43 may be provided on the rear edges of the outer door 32 to seal a gap with the inner door 31 while the outer door 32 is closed. The gasket 42, 43 may include a magnet.

The refrigerator 1 according to an embodiment of the present disclosure may further include a display 60 having an input/output function. The display 60 may be installed on the outer door 32 for the convenience of the user. Specifically, it may be installed on the first outer door 32*a*.

A speaker 50 may be mounted on an upper portion of the body 10 to output music or a warning sound output from a controller (not shown). In addition, a communication module 51 for communicating with external devices may be provided in the upper portion of the inner door 31.

Figure 4:
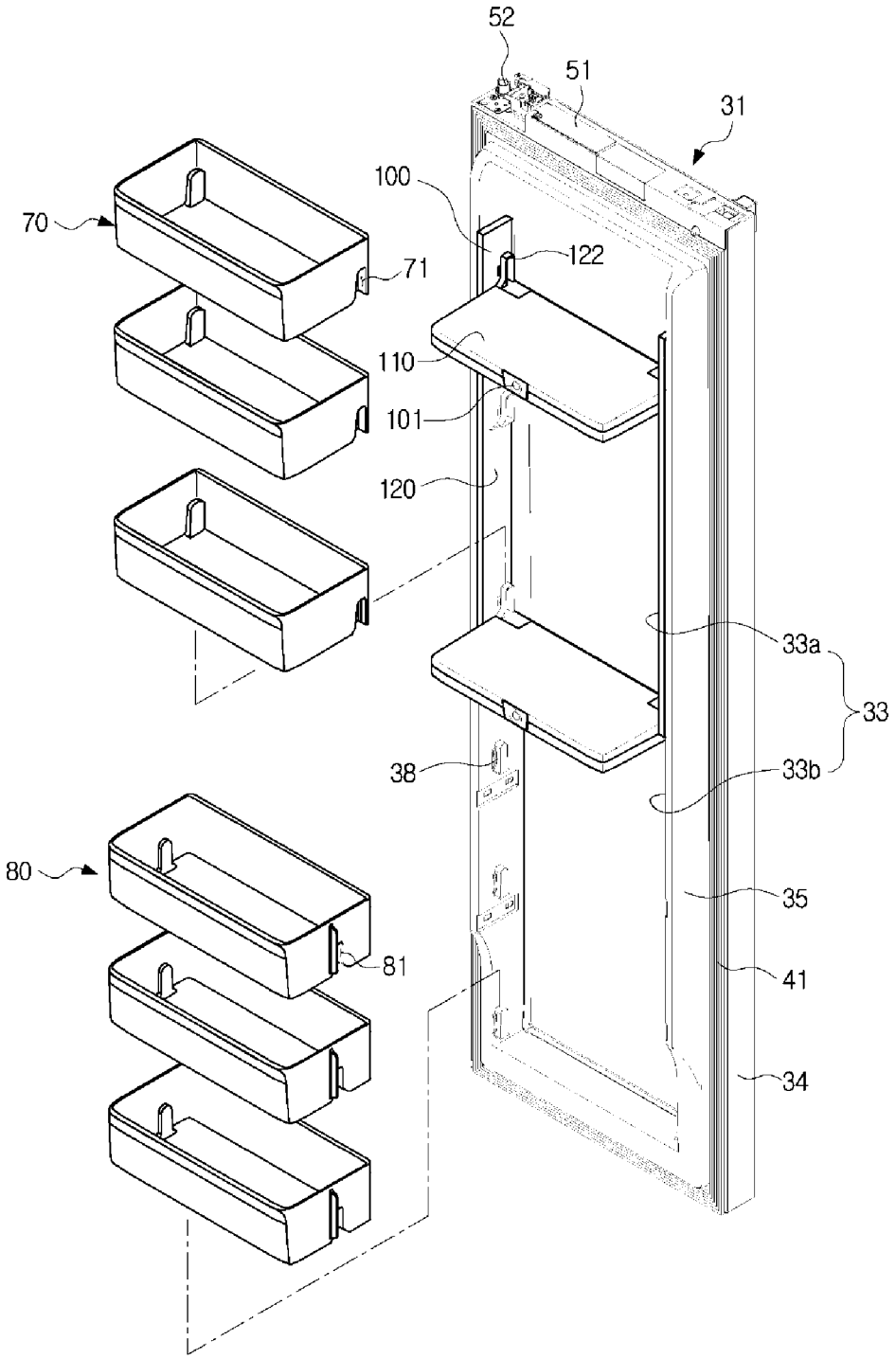
FIG. 4 shows an inner door and a door bin of a refrigerator, according to an embodiment of the present disclosure.
Figure 5:
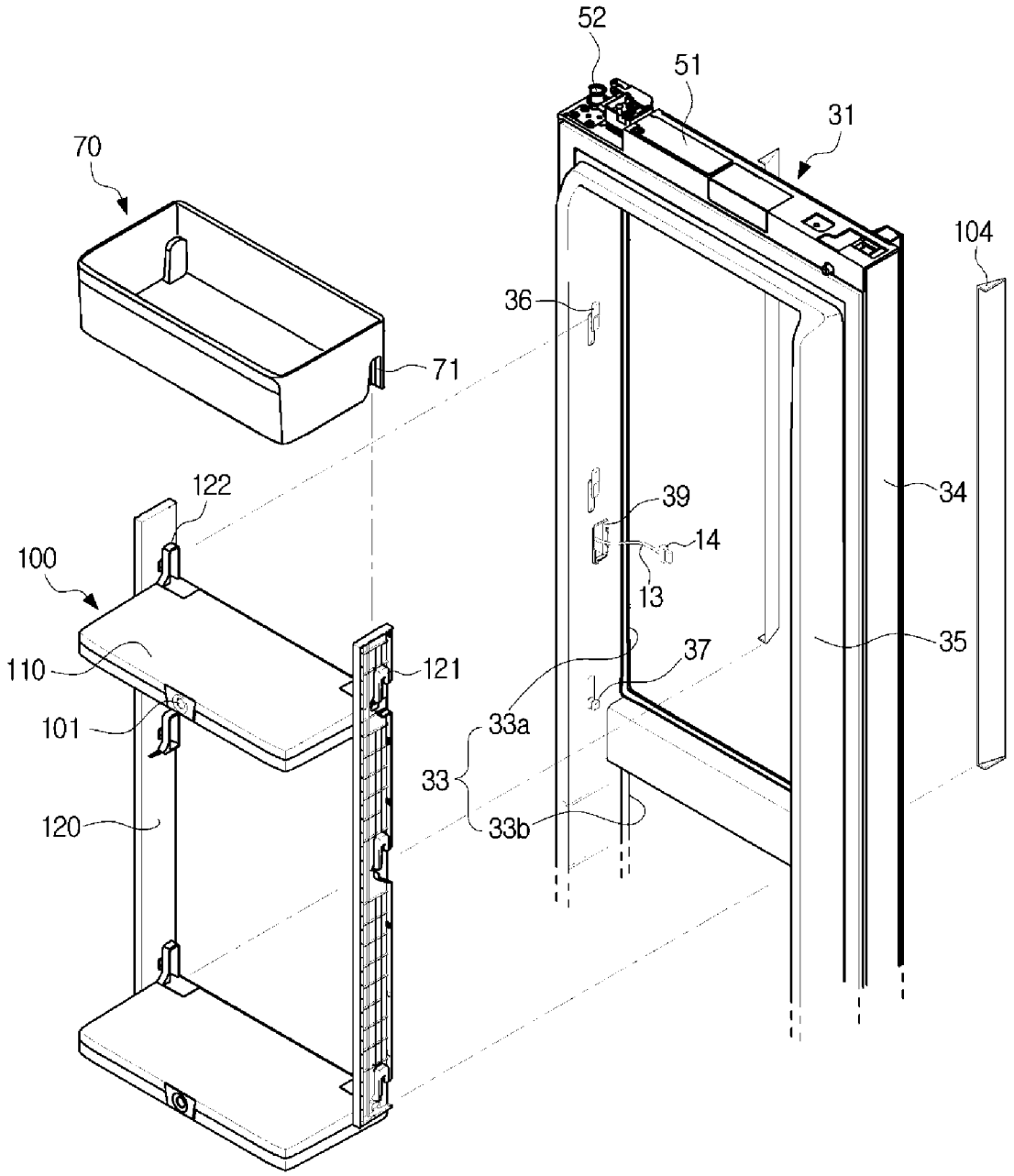
FIG. 5 shows a frame separated from an inner door of a refrigerator, according to an embodiment of the present disclosure.
Figure 6:
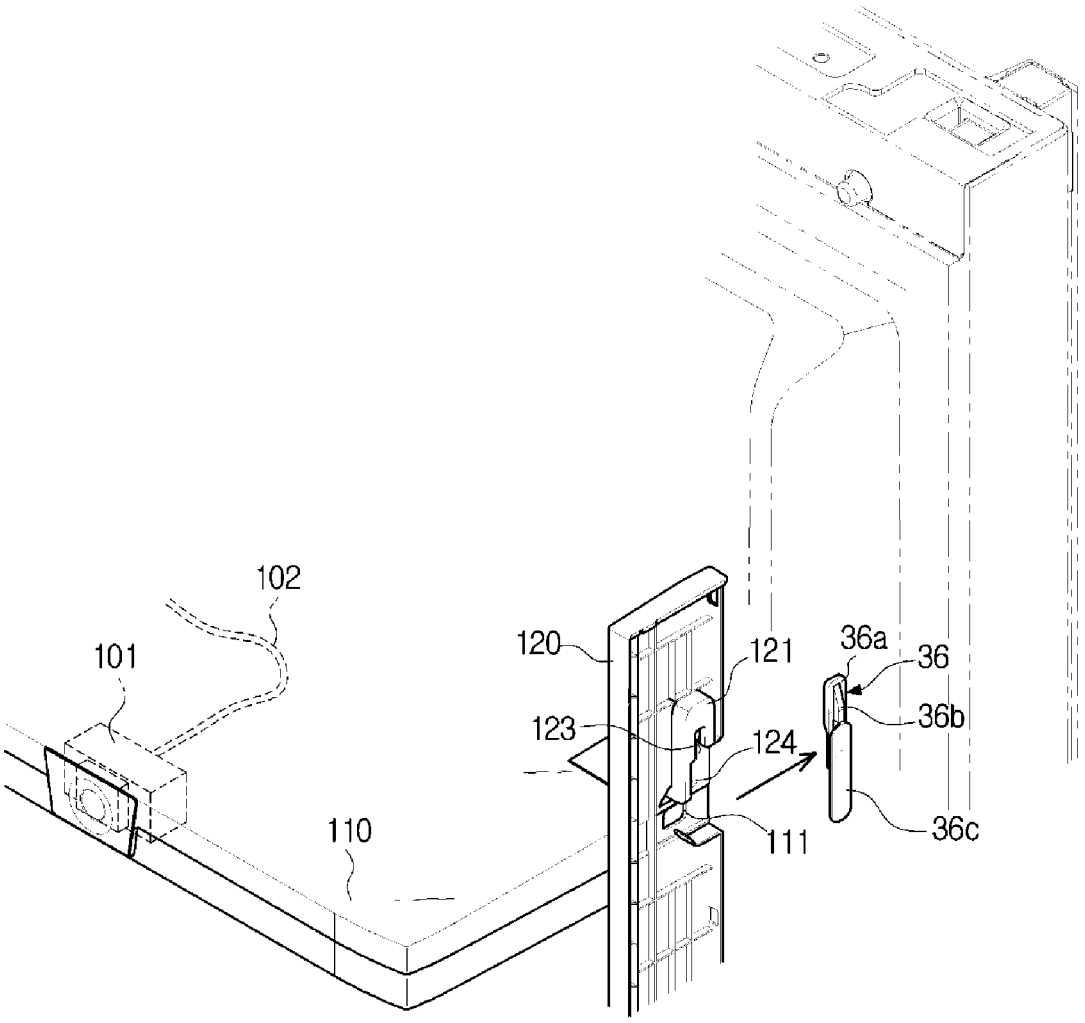
FIG. 6 shows a coupling structure of a frame and an inner door of a refrigerator, according to an embodiment of the present disclosure.

FIG. 4 shows an inner door and a door bin of a refrigerator, according to an embodiment of the present disclosure. FIG. 5 shows a frame separated from an inner door of a refrigerator, according to an embodiment of the present disclosure. FIG. 6 shows a coupling structure of a frame and an inner door of a refrigerator, according to an embodiment of the present disclosure.

According to an embodiment of the present disclosure, the refrigerator 1 may include a frame 100 having a camera configured to photograph the inside of the storage chamber is mounted thereon, and coupled to the inner door. The refrigerator 1 may further include a first door bin 70 detachably coupled to the frame 100 and a second door bin 80 detachably coupled to the rear surface of the inner door 31.

The inner door 31 may include an inner door frame 34 defining an opening 33 and a support portion 35 extending rearward from the rear surface of the inner door frame 34.

As shown in FIG. 4, the frame 100 may be coupled to the rear surface of the inner door 31. The frame 100 may include a housing 110 having the camera 101 installed therein and a coupling bar 120 extending vertically from both ends of the housing 110 and coupled to the support portion 35 of the inner door 31. The frame 100 may accommodate the camera 101 therein and support the first door bin 70 to be fixed. The frame 100 may also accommodate a camera wire 102 for electrically connecting the controller (not shown) installed in the body to the camera 101. At one end of the camera wire 102, a camera connector 103 may be connected to the controller. The one end of the camera wire 102 may be connected to the camera connector 103 and the other end of the camera wire 102 may be connected to the camera 101.

The housing 110 may be provided in the shape of a plate including an accommodation space (not shown) therein. Hereinafter, when the inner door 31 is closed, a surface of the housing 110 facing the first storage chamber 21 is referred to as a front surface of the housing 110.

As shown in FIG. 6, the housing 110 may accommodate the camera 101 and the camera wire 102 therein. The housing 110 may include a wire hole 111 that allows the camera wire 102 to be drawn out from the inside of the housing 100 to the outside. The wire hole 111 may be provided at a connecting portion between the housing 110 and the coupling bar 120. The wire hole 111 may link the inside of the housing 110 and the inside of the coupling bar 120. The wire holes 111 may be provided at both ends of the housing 110, respectively. This is to allow selection of the wire hole from which the camera wire 102 is drawn out according to the structure of the door.

The camera 101 may be installed at the front center of the housing 110. A hole may be formed at the front center of the housing 110 so that a lens of the camera 101 may be exposed.

The camera 101 may be located at the center of the inner door 31 in the width direction. Since the camera 101 is located at the center of the inner door 31 in the width direction, the camera 101 may not lean toward one side and may thus take a distortionless image of the inside of the storage room.

The camera 101 is provided so that a state of the storage chamber 20 may be seen from the outside of the refrigerator 1 without opening the doors 30 and 40. Information obtained by photographing the storage chamber 20 by the camera 101 may be output through the display 60 provided in the refrigerator 1 or an external communicating device (not shown). Further, the information taken by the camera 101 may be stored in a storage device (not shown).

The housing 110 may further include a heating unit (not shown). The heating unit may be located around at least a portion of the camera 101 to apply heat to the camera 101. The heating unit may be provided adjacent to the camera 101 to prevent the frost from being formed in the camera 101. When the inner door 31 is closed, the camera 101 is exposed to the cool air of the first storage chamber 21. If the inner door 31 is opened a while after the camera 101 is exposed to the cool air, the camera 101 may come into contact with the relatively warm outside air, and form the frost. The heating unit may transmit heat to the camera 101 to prevent the forming of the frost in the camera 101.

The coupling bars 120 may be provided in a pair. The coupling bars 120 may extend in a vertical direction from both ends of the housing 110. The coupling bar 120 may be coupled to the support portion 35 of the inner door 31. A method of coupling the coupling bar 120 and the support portion 35 and a structure thereof will be described later.

A plurality of the housings 110 may be provided. For example, as shown in FIG. 5, two housings 110 may be provided. The two housings 110 may be arranged vertically. The plurality of housings 110 may be connected by the coupling bar 120. However, the present disclosure is not limited thereto. Although not shown in the drawing, only one housing 100 may be provided. Even if only one housing 100 is provided, the coupling bar 120 may be provided at both ends of the housing 100.

The coupling bar 120 may include a protrusion coupling portion 121 provided on one surface facing the support portion 35 and a bin coupling portion 122 provided on the other surface opposite to the one surface. The protrusion coupling portion 121 and the bin coupling portion 122 may be provided at positions corresponding to each other.

The first door bin 70 may be detachably coupled to the bin coupling portion 122. A coupling groove 71 may be formed on a side surface of the first door bin 70. The coupling groove 71 may be formed by recessing at least one surface of the first door bin 70. According to an embodiment of the present disclosure, the coupling groove 71 may be formed by recessing a bottom portion and a side portion of the first door bin 70 inwardly.

A bin coupling portion 122 may be inserted into the coupling groove 71. The user may engage the first door bin 70 to the frame 100 by inserting the bin coupling portion 122 of the frame 100 into the coupling groove 71. Conversely, the first door bin 70 may be separated from the frame by lifting the first door bin 70 and pulling the bin coupling portion 122 out of the coupling groove 71.

The first door bin 70 may be arranged to contact the upper surface of the housing 110. Specifically, the lower surface of the first door bin 70 may be arranged to be in contact with the upper surface of the housing 110. The lower surface of the first door bin 70 and the upper surface of the housing 110 may be provided in corresponding sizes and shapes. The housing 110 may contact the first door bin 70 to support the first door bin 70 upward. The first door bin 70 may be supported not by the housing 110 but by the bin coupling portion 122.

The lower surface of the first door bin 70 and the upper surface of the housing 110 may have the same size and shape so that a sense of unity may be given when the first door bin 70 is coupled to the housing 110.

A plurality of bin protrusions 38 may be provided on the inner surface of the support portion 35 to be spaced vertically.

The second door bin 80 may be detachably coupled to the inner door 31. Specifically, the second door bin 80 may include an insertion groove 81 into which the bin protrusion 38 is inserted. When the bin protrusion 38 is inserted into the insertion groove 81, the second door bin 80 may be coupled to the support portion 35. Like the first door bin 70, the second door bin 80 may be detached from the support portion 35 by pulling the bin protrusion 38 out of the insertion groove 81.

The first door bin 70 may be coupled to the frame 100 after the frame 100 is coupled to the support portion 35. On the other hand, the second door bin 80 may be directly coupled to the support portion 35. That is, since the frame 100 is not provided between the second door bin 80 and the support portion 35, the second door bin 80 may be provided to be bigger than the first door bin 70.

Hereinafter, the coupling structure of the frame 100 and the support portion 35 will be described in detail with reference to FIGS. 5 and 6.

The support portion 35 may include a coupling protrusion 36 provided on the inner surface of the support portion 35. The frame 100 may include a protrusion coupling portion 121 provided on the outer surface of the coupling bar 120. The frame 100 may be coupled to the support portion 35 by engaging the coupling protrusion 36 with the protrusion coupling portion 121.

The coupling protrusion 36 may include a body portion **36*c* arranged inside the support portion 35, a head portion 36*a* inserted into the protrusion coupling portion 121, and a connecting portion 36*b* connecting the head portion 36*a* and the body portion 36*c***.

The protrusion coupling portion 121 may include a through hole 124 through which the head portion **36*a* passes. When the coupling protrusion 36 is engaged with the protrusion coupling portion 121, the head portion 36*a* may be located in the inner space of the bin coupling portion 122 through the through hole 124**.

The protrusion coupling portion 121 may include a guide groove 123 for guiding the connecting portion 36*b*. As shown in FIG. 6, when the coupling bar 120 is moved in a direction of the arrow to couple to the support portion 35, the guide groove 123 and the coupling portion 36*b* come into contact with each other and a movement in the direction of the arrow is restricted. When the guide groove 123 and the connecting portion 36*b* are in contact with each other, the frame 100 may be moved downward to couple the frame 100 to the support portion 35. At this time, the connecting portion 36*b* may be guided by the guide groove 123, which may facilitate the engagement of the coupling protrusion 36 and the protrusion coupling portion 121.

The support portion 35 may further include an auxiliary coupling protrusion 37 provided on a lower side of the coupling protrusion 36.

The auxiliary coupling protrusion 37 may be engaged with the frame 100. A portion protruding outward from the support portion 35 of the auxiliary coupling protrusion 37 may be smaller than a portion protruding outward from the support portion 35 of the coupling protrusion 36. The auxiliary coupling protrusion 37 may be coupled to the protrusion coupling portion 121 like the coupling protrusion 36.

The auxiliary coupling protrusion 37 provided to be smaller than the coupling protrusion 36 makes it easier to separate the auxiliary coupling protrusion 37 from the protrusion coupling portion 121 than to separate the coupling protrusion 36 from the protrusion coupling portion 121. Therefore, when the frame 100 is to be separated from the inner door 31, the frame 100 may be easily separated from the inner door 31 by separating the protrusion coupling portion 121 from the auxiliary coupling projection 37 first.

Figure 7:
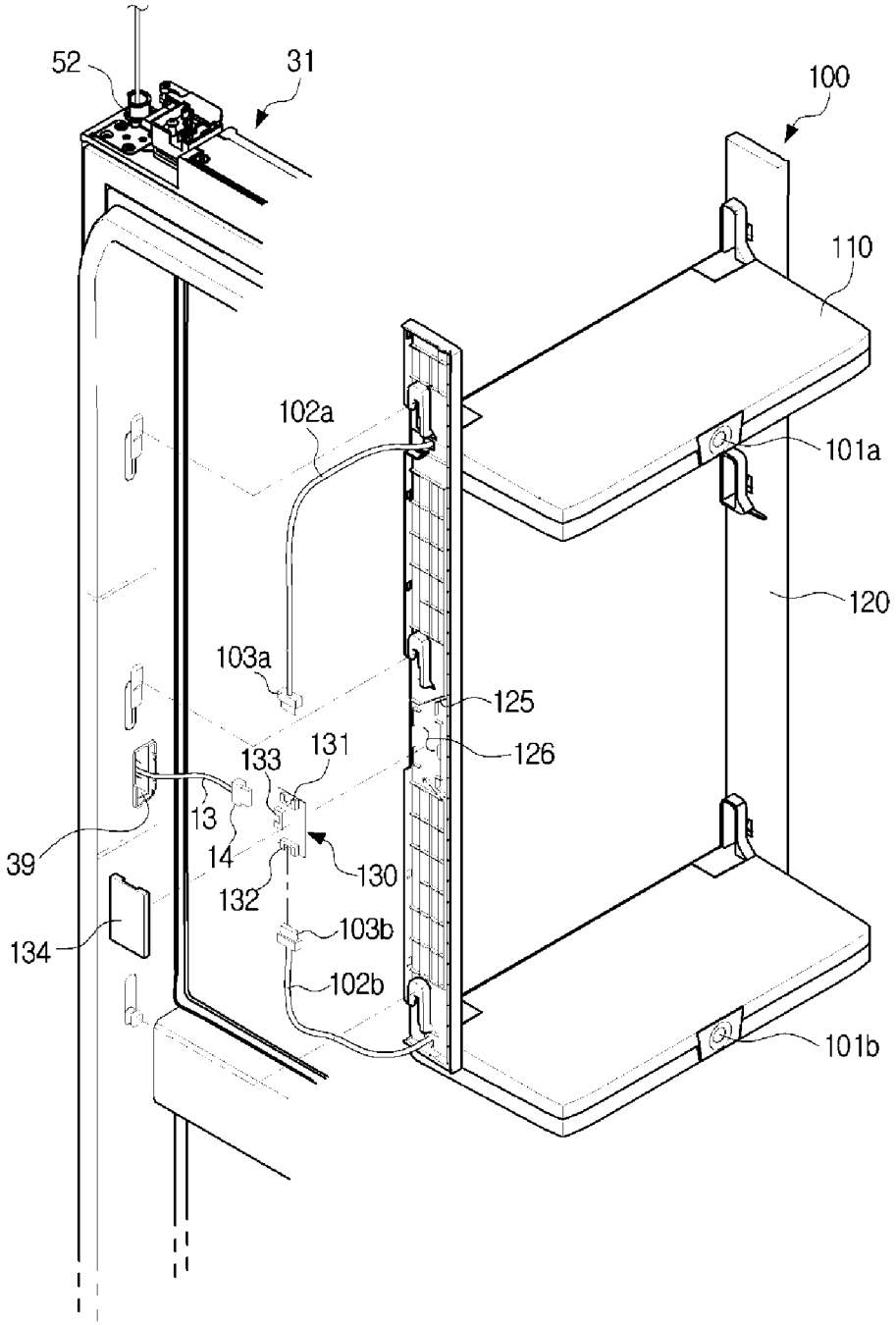
FIG. 7 shows a connecting structure of wires and connectors in a refrigerator, according to an embodiment of the present disclosure.
Figure 8:
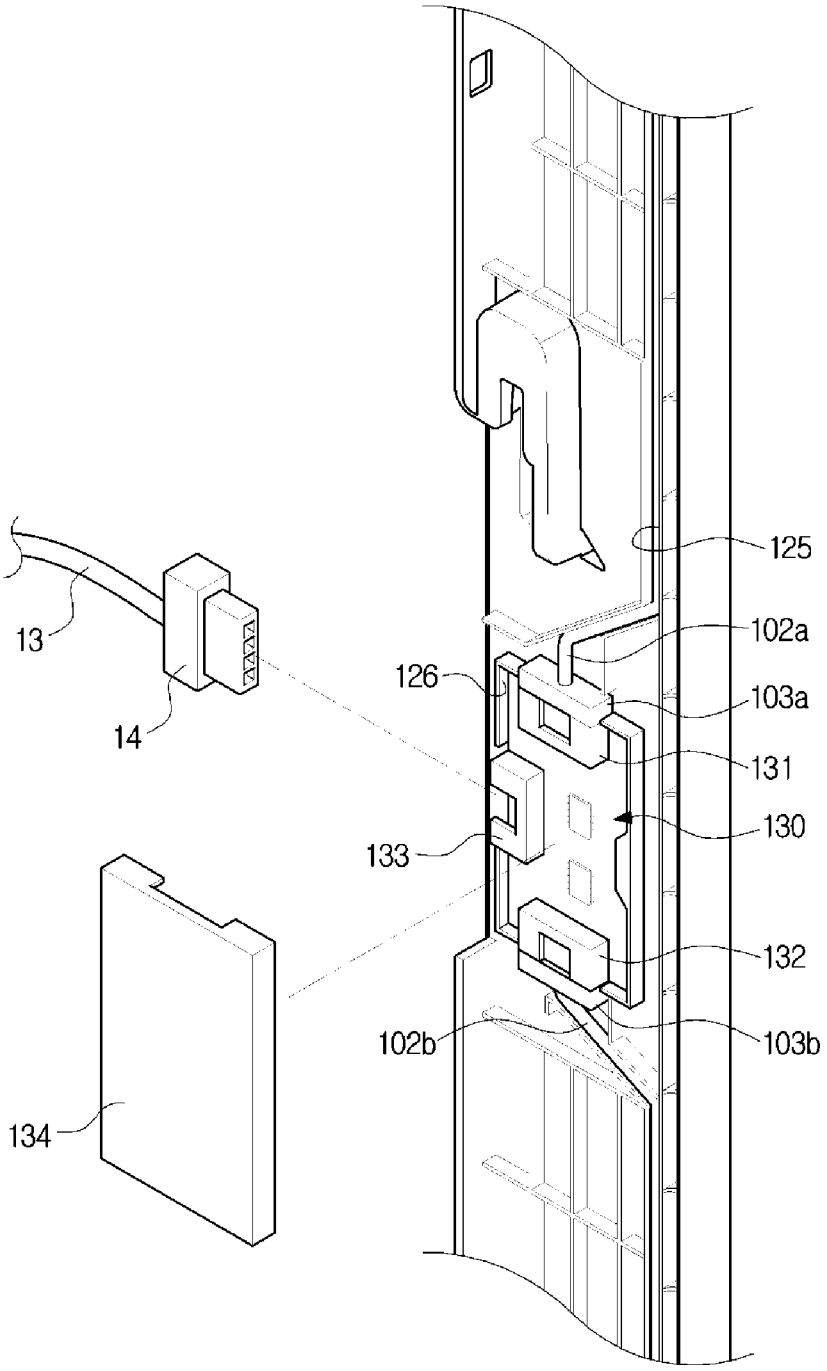
FIG. 8 is a view illustrating a connector module mounted on a coupling bar, and a camera connector and a camera wire connected to the connector module in a refrigerator, according to an embodiment of the present disclosure.
Figure 9:
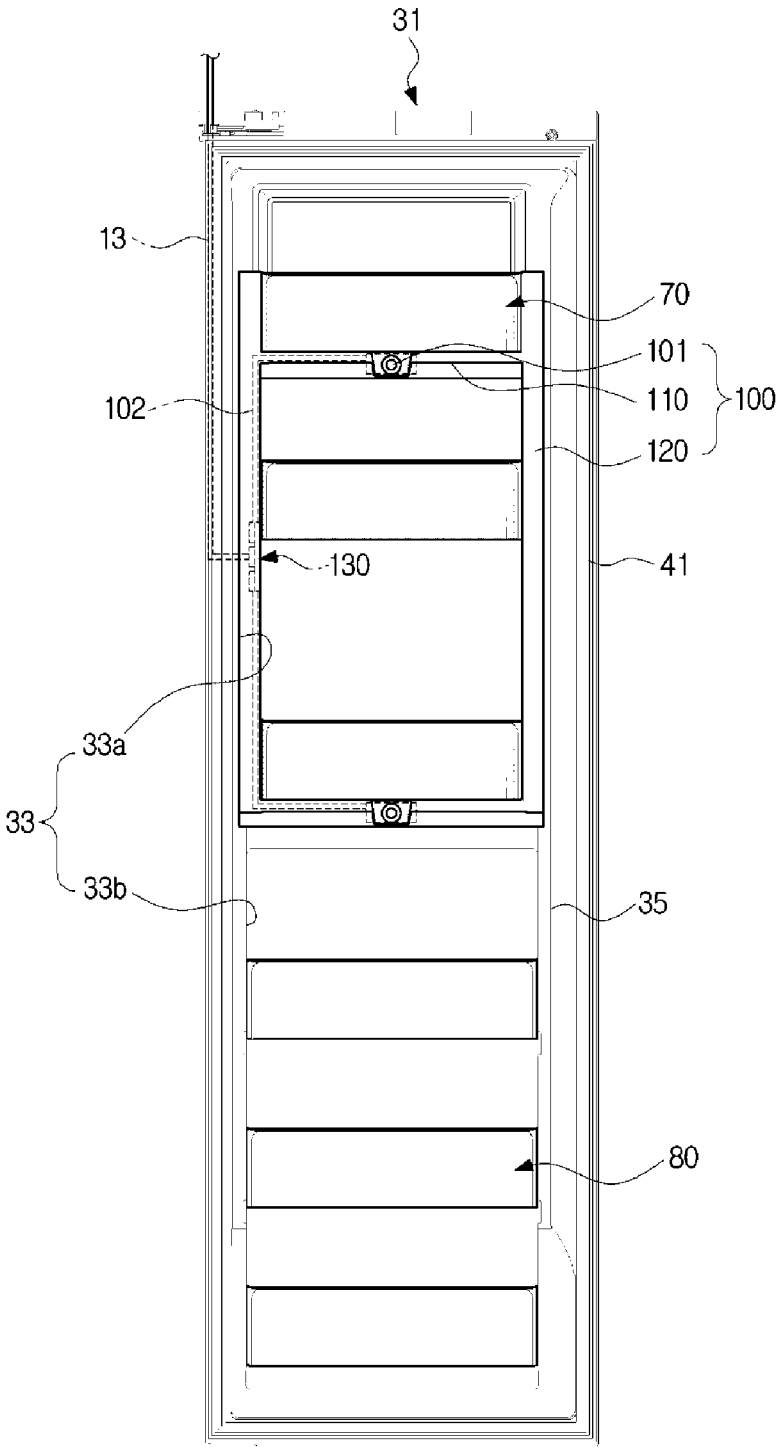
FIG. 9 is a front view of an inner door of a refrigerator, according to an embodiment of the present disclosure.

FIG. 7 shows a connecting structure of wires and connectors in a refrigerator, according to an embodiment of the present disclosure. FIG. 8 shows a connector module mounted on a coupling bar, and a camera connector and a camera wire connected to the connector module in a refrigerator, according to an embodiment of the present disclosure. FIG. 9 is a front view of an inner door of a refrigerator, according to an embodiment of the present disclosure.

The camera 101 may be electrically connected to the controller (not shown) inside the body 10 through a camera wire 102 and a camera connector 103.

A connector module 130 may be provided in a space between the coupling bar 120 and the support portion 35. The camera connector 103 may be connected to the connector module 130.

The support portion 35 may include a connector hole 39. The refrigerator 1 may include a body wire 13 drawn out from the inside of the body 10 through the connector hole 39 and a body connector 14 connected to an end of the body wire 13.

The body wire 13 and the body connector 14 may be pulled out through the connector hole 39 via a wire connecting portion 52 provided at an upper end of the inner door 31 and the inner space (not shown) of the inner door 31 from the inside of the body 10.

As shown in FIGS. 7 to 9, one end of the camera wire 102 is connected to the camera 101 inside the housing 110 and the other end of the camera wire 102 passes through the wire hole 111 and is connected to the connector module 130 which is coupled to the coupling bar 120.

The frame 100 may include the connector module 130. The body wire 13 connected to the inside of the inner door 31 through the wire connecting portion 52 may be provided in the inside of the inner door 31. A body connector 14 may be connected to an end of the body wire 13.

According to an embodiment of the present disclosure, the housing 110 may include a first housing 110*a* and a second housing 110*b*, which are arranged vertically. A first camera 101*a* and a first camera wire 102*a* may be accommodated in the first housing 110*a*. A second camera 101*b* and a second camera wire 102*b* may be accommodated in the second housing 110*b*. A first camera connector 103*a* may be connected to an end of the first camera wire 102*a* and a second camera connector 103*b* may be connected to an end of the second camera wire 102*b*.

The connector module 130 may include a first connector 131 connected to the first camera connector 103*a*, a second connector 132 connected to the second camera connector 103*b*, and a third connector 133 connected to the body connector 14.

However, the present disclosure is not limited thereto. The housing, and the camera and the camera wire accommodated in the housing may be provided in one piece, or may be provided in three or more pieces. Accordingly, the connector module may include two connectors or may include four or more connectors.

The connector module 130 may be coupled to the outer surface of the coupling bar 120. The outer surface of the coupling bar 120 may correspond to a surface facing the support portion 35. A connector groove 126 may be formed on the outer surface of the coupling bar 120 to receive the connector module 130. A wire groove 125 for fixing the camera wire 102 may be formed on the outer surface of the coupling bar 120. The connector module 130 may be inserted and fixed in the connector groove 126 and the camera wire 120 may be inserted and fixed in the wire groove 125.

A connector cover 134 may be coupled to the outer surface of the coupling bar 120 after the connector module 130 is inserted into the connector groove 126. The connector cover 134 may be coupled to the outer surface of the coupling bar 120 to cover the connector module 130. As a result, the connector module 130 and the connectors connected thereto may be protected from external shocks. Alternatively, the connector cover 134 may be omitted by the designers intention. That is, the connector cover 134 may be optional.

The support portion 35 may be provided with the connector hole 39, through which the body wire 13 and the body connector 14 may be pulled out. The body wire 13 and the body connector 14, which are connected to the inside of the body 10, may be located inside the inner door 31. The body wire 13 and the body connector 14 may be pulled out of the support portion 35 through the connector hole 39 as described above.

The body connector 14 may be connected to the third connector 133 of the connector module 130. The body connector 14 may be connected to the third connector 133 before or after the frame 100 is coupled to the inner door 31.

When the body connector 14 is connected to the third connector 133, the controller (not shown) provided inside the body 10 and the camera 101 may be electrically connected. The first camera connector 103*a*, the second camera connector 103*b* and the body connector 14 may be connected to the first, second and third connectors 131, 132 and 133 of the connector module 130, respectively, and the first camera 101*a* and the second camera 101*b* may thus be electrically connected to the controller (not shown).

According to an embodiment of the present disclosure, the frame 100 may further include a frame cover 104.

The frame cover 104 may be coupled to the frame 100 after the frame 100 is coupled to the inner door 31. The frame cover 104 may be coupled to one surface of the frame 100 to cover the connector and the wire so that they are not exposed to the outside. The frame cover 104 is provided with a protrusion, and the frame 100 may be provided with a groove into which the protrusion is inserted. Alternatively, the frame cover 104 and the frame 100 may be couple through a groove provided in the frame cover 104 and a protrusion provided on the frame 100. There are no limitations on coupling methods, but considering the ease of assembly, it is preferable to have a coupling method that requires no separate fastening means.

When the camera is to be installed for photographing the inside of the storage chamber, the installation position of the camera and handling of the wire is important. It is preferable that the camera may photograph the inside of the storage chamber without distortion while having no object obstructing the forward view of the camera. When the wire is exposed to the outside, the inside of the refrigerator becomes complicated and an aesthetic sense may deteriorate. Therefore, it is preferable that the wire is not exposed to the outside. When the camera and the wire are easily installed, the productivity may be improved.

According to an idea of the present disclosure, by coupling the frame 100 to the refrigerator door, the installation of the camera 101 and the handling of the wires 102 and 13 may be solved at one time. Furthermore, since the camera 101 and the wire 102 are located inside the frame 100, the camera 101 and the wire 102 are not exposed to the outside. Since the camera 101 is installed inside the housing 110 and the first door bin 70 is arranged on the upper portion of the housing 110, there is no concern about the food contained in the first door bin 70 and the first door bin 70 itself obstructing the forward view of the camera 101.

Hereinafter, a refrigerator according to another embodiment of the present disclosure will be described. The description of the same configuration as that described above will be omitted.

Figure 10:
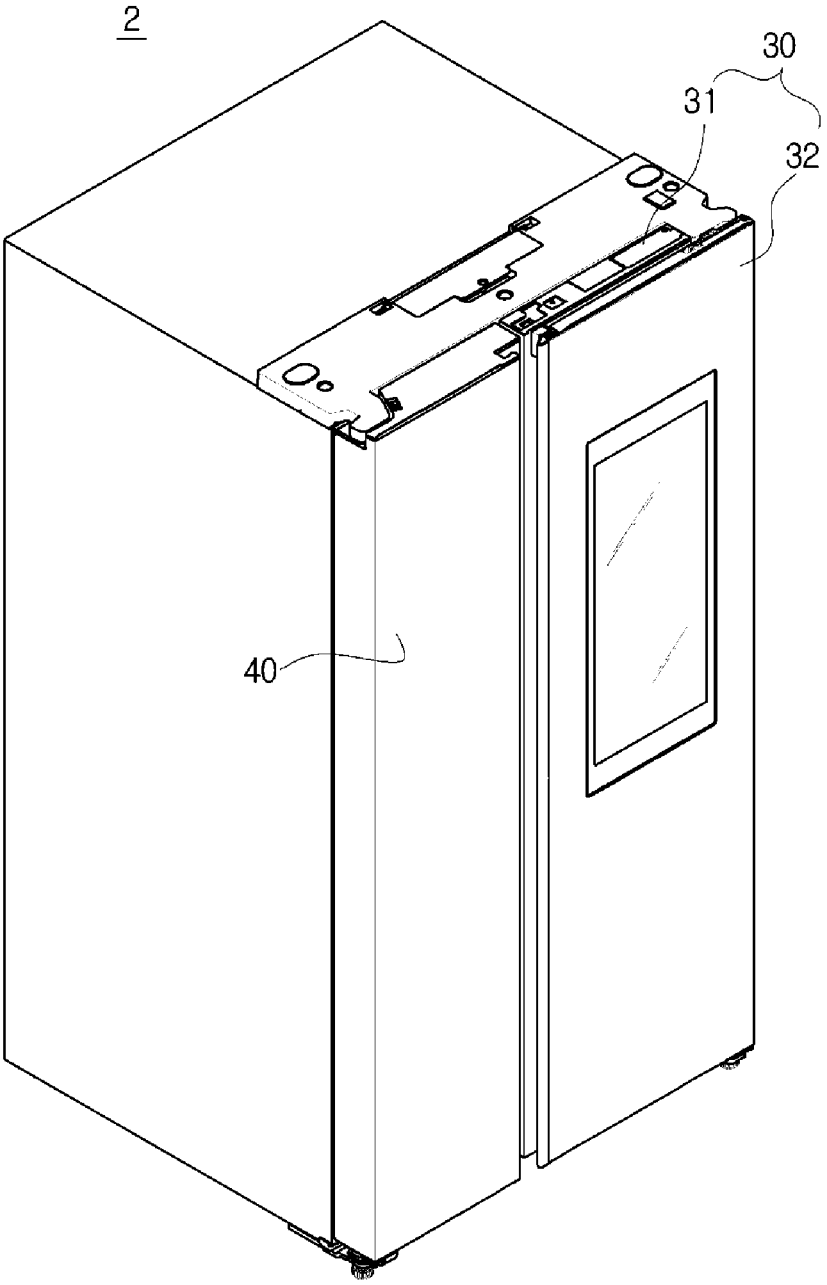
FIG. 10 is an exterior view of a refrigerator, according to another embodiment of the present disclosure.
Figure 11:
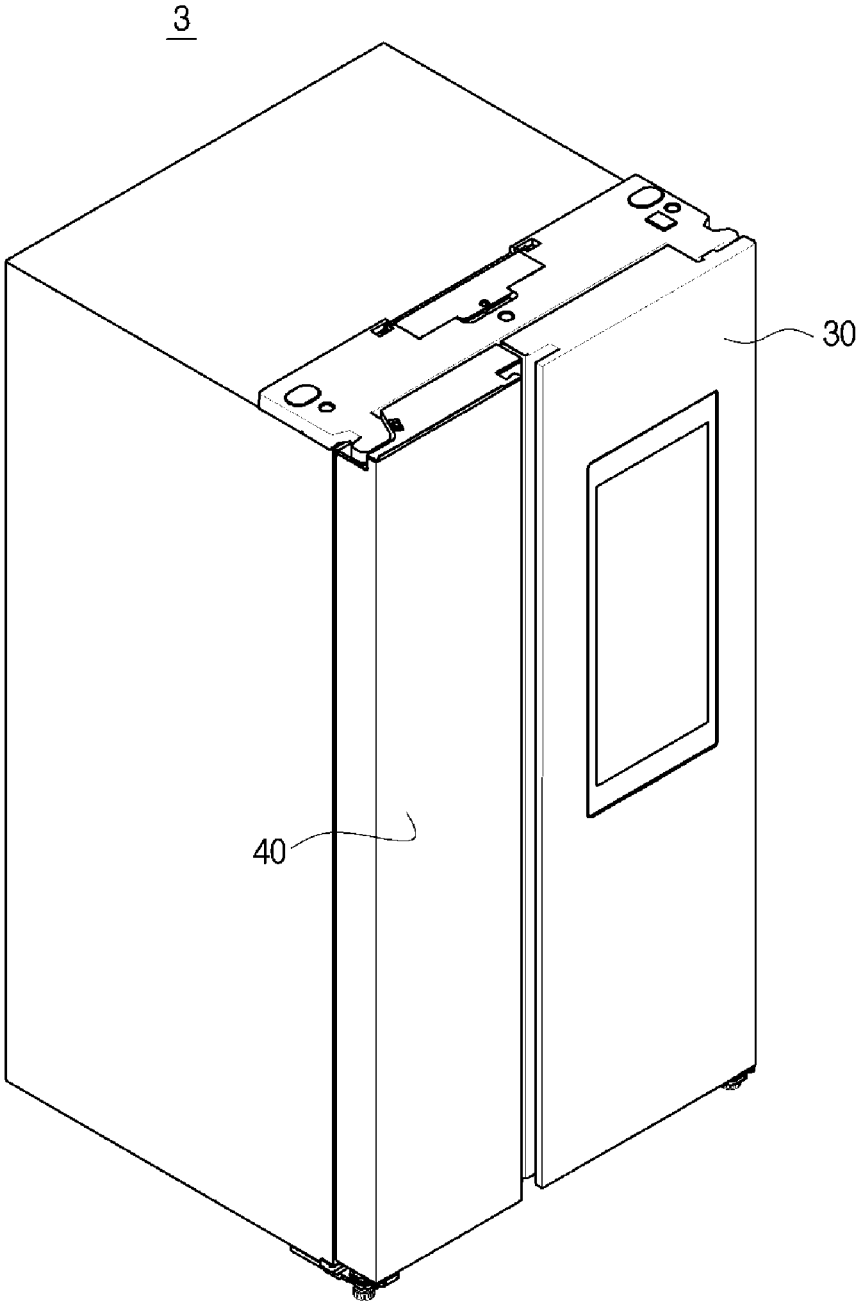
FIG. 11 is an exterior view of a refrigerator, according to another embodiment of the present disclosure.

FIG. 10 is an exterior view of a refrigerator, according to another embodiment of the present disclosure. FIG. 11 is an exterior view of a refrigerator, according to another embodiment of the present disclosure.

A refrigerator 2 according to another embodiment of the present disclosure may include the first door 30 and the second door 40. The first door 30 may include the inner door 31 and the outer door 32. In this case, the second door 40 and the outer door 32 are not vertically separated.

A refrigerator 3 according to another embodiment of the present disclosure may include the first door 30 and the second door 40. The first door 30 and the second door 40 may be provided as ordinary doors rather than the double door.

According to embodiments of the present disclosure, a refrigerator capable of photographing a storage chamber may be provided.

According to embodiments of the present disclosure, a refrigerator allowing the user to see the inside of a storage chamber from the outside may be provided.

According to embodiments of the present disclosure, a refrigerator having a camera positioned at the center of a door in the width direction to take a distortionless image of the inside of the storage chamber may be provided.

According to embodiments of the present disclosure, a refrigerator that facilitates coupling of a frame having a camera mounted thereon with the rear side of a door without need for a separate fastening member may be provided.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body having a storage chamber;

a door rotatably coupled to the body to open or close the storage chamber; and a frame coupled to the door and to which a first door bin and a second door bin are coupled, wherein the frame includes:

a housing including a first housing in which a first camera to capture an image of an inside of the storage chamber is installed and a second housing arranged at a lower portion of the first housing and in which a second camera to capture an image of the inside of the storage chamber is installed, a coupling bar vertically connecting the first housing to the second housing and coupled to the door, and a connector module coupled to the coupling bar, wherein the connector module includes:

a first connector connected to a first camera wire that is connected to the first camera, a second connector connected to a second camera wire that is connected to the second camera, and a third connector connected to a body wire that is connected to the inside of the body, and wherein the first door bin is arranged at an upper portion of the first housing and supported by the first housing, and the second door bin is arranged at an upper portion of the second housing and supported by the second housing.

2. The refrigerator of claim 1, wherein the first camera wire is accommodated in the first housing, and the second camera wire is accommodated in the second housing.

3. The refrigerator of claim 2, wherein the housing includes a wire hole linking the housing to the coupling bar, and the first camera wire and the second camera wire are withdrawn out of the first housing and the second housing, respectively, through the wire hole.

4. The refrigerator of claim 1, wherein the door includes a support to which the coupling bar is coupled, and the support includes a connector hole through which the body wire is withdrawn out of the body.

5. The refrigerator of claim 4, wherein the first camera wire is connected at an end tip thereof to a first camera connector to which the first connector is connected, the second camera wire is connected at an end tip thereof to a second camera connector to which the second connector is connected, and the body wire is connected at an end tip thereof to a body connector that is connected to the third connector.

6. The refrigerator of claim 1, wherein the coupling bar includes a connector groove into which the connector module is inserted, and the connector module is inserted into the connector groove to be coupled to the coupling bar.

7. The refrigerator of claim 6, wherein the coupling bar includes a connector cover coupled to the coupling bar to cover the connector module.

8. The refrigerator of claim 1, wherein the coupling bar includes a wire groove to which the first camera wire and the second camera wire are fixed.

9. The refrigerator of claim 1, wherein the frame includes a frame cover coupled to the frame to cover the first camera wire, the second camera wire, the body wire, and the connector module to prevent the first camera wire, the second camera wire, the body wire, and the connector module from being exposed to an outside.

10. The refrigerator of claim 9, wherein the frame cover is provided with a protrusion, and the frame is provided with a groove into which the protrusion is inserted.

* * * * *